United States Patent [19]

Clements

[11] 4,423,837

[45] Jan. 3, 1984

[54] NEEDLE CONSTRUCTION FOR TAG ATTACHERS

[75] Inventor: Alan Clements, Tappan, N.Y.

[73] Assignee: Ben Clements & Sons, Inc., South Hackensack, N.J.

[21] Appl. No.: 291,521

[22] Filed: Aug. 12, 1981

Related U.S. Application Data

[63] Continuation-in-part of Ser. No. 251,671, Apr. 21, 1981, abandoned.

[51] Int. Cl.[3] ..... B65C 7/00

[52] U.S. Cl. ..... 227/67; 24/150 R; 24/456; 112/222; 128/330; 227/76; 227/156; 411/517

[58] Field of Search ..... 227/64, 67, 68, 76, 227/156; 112/80, 222, 223, 224, 225, 226, 227; 223/102; 24/150 R, 155 C, 256, 339, 340; 128/330; 604/272; 411/517, 521, 522, 353

[56] References Cited

U.S. PATENT DOCUMENTS

| | | | |
|---|---|---|---|
| Re. 29,819 | 10/1978 | Bone . | |
| 2,487,803 | 11/1949 | Heimann | 411/517 |
| 2,755,698 | 7/1956 | Wurzel | 411/517 |
| 3,895,753 | 7/1975 | Bone | 227/67 |
| 3,924,788 | 12/1975 | Furutu | 227/67 |
| 4,049,178 | 9/1977 | Strausburg . | |

FOREIGN PATENT DOCUMENTS

| | | | |
|---|---|---|---|
| 605817 | 1/1933 | Fed. Rep. of Germany | 411/517 |

*Primary Examiner*—Fred A. Silverberg
*Attorney, Agent, or Firm*—Blum, Kaplan, Friedman, Silberman & Beran

[57] ABSTRACT

An improved needle construction for use in tag attachers. The needle includes an elongated body having a mounting end and a piercing end. The mounting end of the body is releasably securable to the tag attacher. The piercing end of the body includes a sharp point for piercing the article to be tagged. The elongated body includes an enlarged collar proximate the mounting end of the body which abuts against the front surface of the tag attacher when the needle is secured thereon.

22 Claims, 7 Drawing Figures

FIG. 1
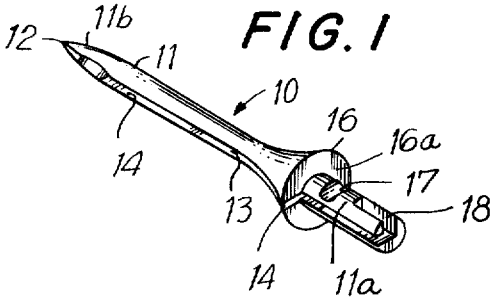
FIG. 2
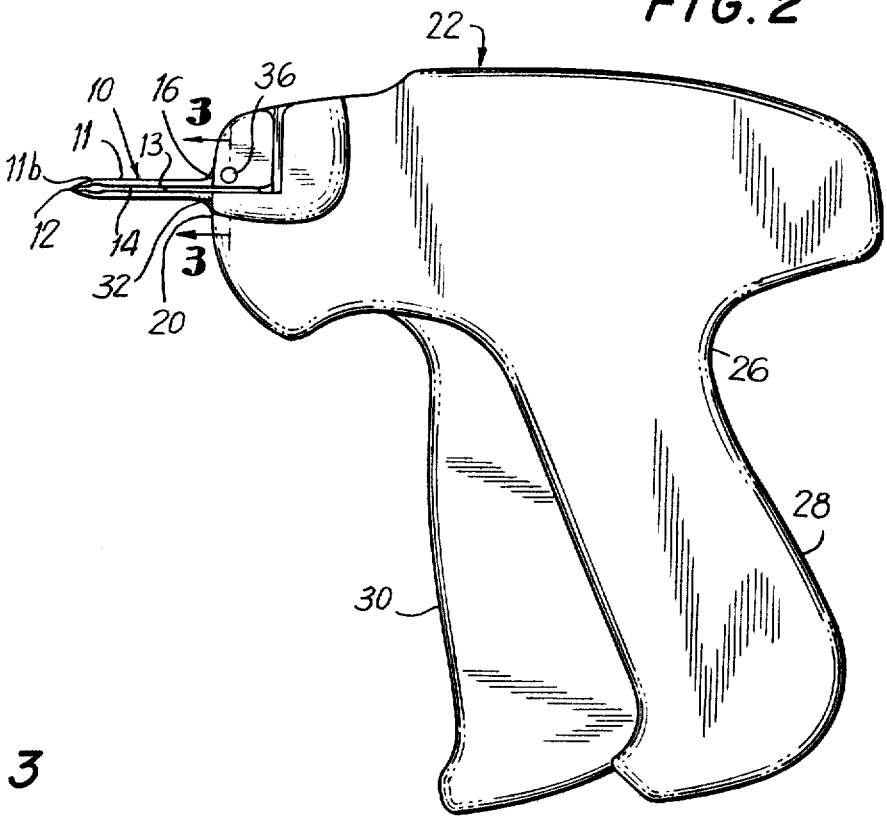
FIG. 3
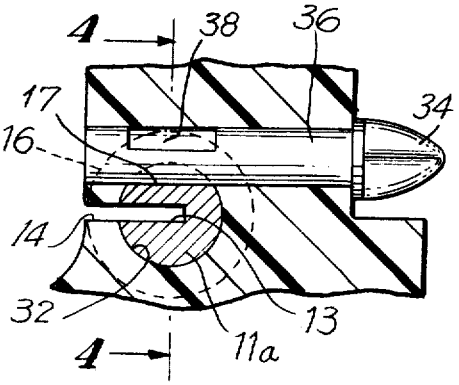
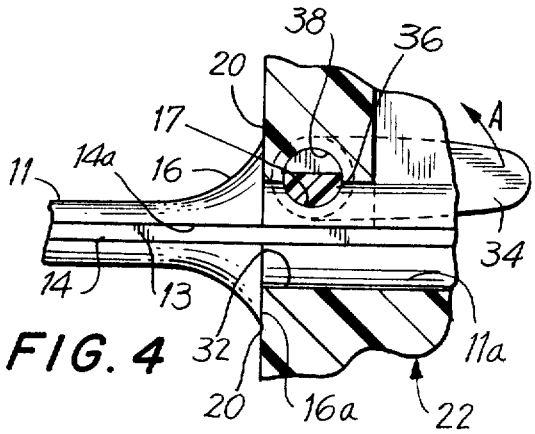
FIG. 4

FIG. 5
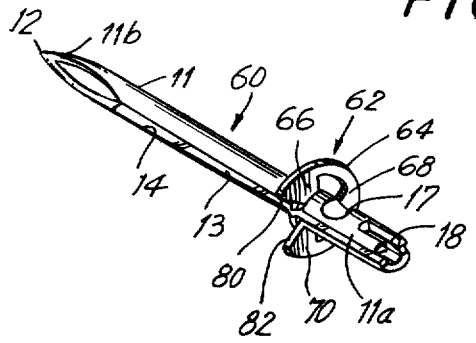
FIG. 6
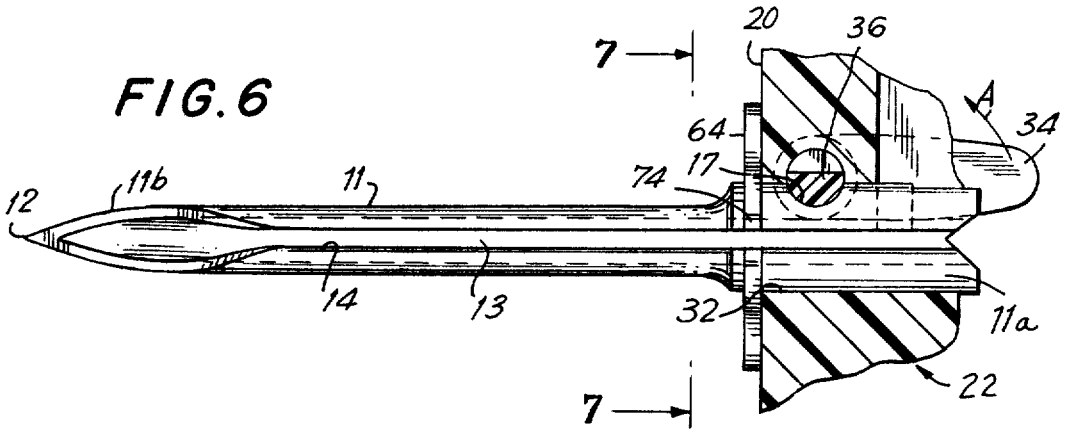
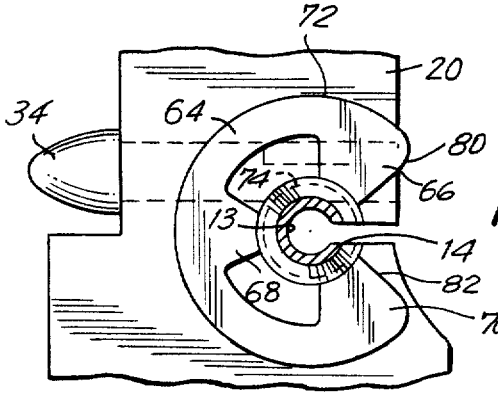
FIG. 7

NEEDLE CONSTRUCTION FOR TAG ATTACHERS

CROSS-REFERENCE TO RELATED APPLICATION

This application is a continuation-in-part application based on parent application Ser. No. 6/251,671, filed on Apr. 21, 1981 and entitled Needle Construction for Tag Attachers, now abandoned.

BACKGROUND OF THE INVENTION

This invention relates to an improved needle construction for tag attaching devices. Tag attaching devices of the type disclosed in U.S. Pat. No. 3,924,788 include a mechanism in the shape of a gun having a needle coupled to the front end of the device. Such devices are used to attach tags or the like to a variety of articles by means of fasteners having a bar section joined to a head section by a filament. The needle is used to pierce the article to be tagged so that the fastener can be inserted through the article to hold a tag thereto.

Over the years it has been found that conventional needles used in tag attachers tend to snap or break easily due to forces exerted laterally of the needle when the tag attaching apparatus is being used thereby requiring frequent replacement of the needle. Frequently, the adjacent surface of the tag attaching gun where the needle is coupled will tend to crack or break when lateral forces are exerted thereon by the needle when in use. Furthermore, conventional needles are frequently pushed into the gun by axial stresses during use resulting in elongation and distortion of the needle opening and damage to the plastic components which mount the needle. These undesirable effects are minimized if not eliminated by the novel needle construction of the present invention.

Accordingly, it is desired to provide an improved needle construction for tag attachers which inhibits or minimizes breakage of the needle and the coupling region of the tag attaching apparatus.

SUMMARY OF THE INVENTION

Generally speaking, in accordance with the invention, a needle construction is provided for use in tag attachers. The needle includes an elongated body having a first mounting end and a second piercing end. The first end of the body is releasably attached to the front end or forward surface of the tag attacher. The second end of the elongated body is shaped into a point for piercing the article to be tagged. The body includes an enlarged collar such as a flange or disk proximate the first end of the body which abuts against the front surface of the tag attacher when the needle is secured thereto. The collar prevents the needle and the front surface of the tag attacher from breaking when the tag attacher is in use and lateral stresses are applied thereto.

The needle includes a longitudinally extending bore through which a pushing rod of the tag attacher can pass. A longitudinal slot in the needle allows a tag fastener to slide down the needle and into the article to be tagged.

Accordingly, it is an object of the invention to provide an improved needle construction for tag attachers.

Another object of the invention is to provide an improved needle construction for use with tag attachers which prevents or inhibits breaking of both the needle and the tag attaching apparatus.

A further object of the invention is to provide an improved needle construction which is usable in connection with conventional tag attachers.

Still other objects and advantages of the invention will in part be obvious and will in part be apparent from the specification.

The invention accordingly comprises the features of construction, combination of elements, and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is perspective view of a needle constructed in accordance with a first embodiment of the present invention;

FIG. 2 is a side elevational view of a tag attaching apparatus having a needle constructed in accordance with the first embodiment of the present invention mounted thereon;

FIG. 3 is an enlarged sectional view taken along line 3—3 of FIG. 2;

FIG. 4 is a sectional view taken along line 4—4 of FIG. 3;

FIG. 5 is a perspective view of a needle constructed in accordance with a second embodiment of the present invention;

FIG. 6 is an enlarged sectional view similar to FIG. 4 but depicting the needle of FIG. 5 shown mounted in the nose of a tag attacher; and FIG. 7 is a sectional view taken along line 7—7 of FIG. 6.

DESCRIPTION OF THE PREFERRED EMBODIMENT

Reference is first made to FIG. 1 wherein a needle, generally indicated as 10, and constructed in accordance with a first embodiment of the invention, is depicted. Needle 10 is preferably constructed from metal. Needle 10 is adapted for use in tag attachers as will be described in detail below. Needle 10 includes an elongated body 11 having a first mounting end **11*a* and a second piercing end 11*b*. First end 11*a* of needle 10 is adapted to be attached in the front end 20 of tag attacher 22 (FIG. 2) which acts as the complimentary mounting for needle 10. Second end 11*b* of needle 10 includes a sharp point 12 which is used for piercing the article or garment to be tagged. Second end 11*b* is also beveled in order to permit fasteners to be pushed out of needle 10. The fasteners used in connection with needle 10** are conventional and generally include a bar section and a head section joined together by a filament.

Needle 10 includes a longitudinally extending bore 13 and a corresponding longitudinally extending slot 14. Bore 13 allows the bar section of a fastener to pass through the needle. Slot 14 allows the filament of the fastener which couples the head section to the bar section to slide along the longitudinal extent of needle 10.

Proximate first end **11*a* of needle 10 is an enlarged collar or flange 16 which is integrally formed with needle body 11. As depicted, collar 16 is flared towards the first end 11*a* of needle 10 for providing structural reinforcement thereto. More particularly, collar 16 is thickened and terminates in a planar face 16***a* which interfits with the nose 20 of the attacher 22 for reinforcement of this connection to inhibit breakage thereat or damage thereto especially when abnormal lateral stresses are applied to the needle during attaching operations. It is noted that slot 14 extends along the length of body 11 and includes a portion 14*a* extending through collar 16.

First end 11*a* of needle 10 includes a second slotted portion 18 disposed 90° from slot 14 for receiving the bar section of a fastener entering the bore 13 in the needle.

Reference is now made to FIGS. 2 through 4 in addition to FIG. 1 in order to explain the use of needle 10 in conjunction with a tag attacher, generally indicated as 22. Tag attacher 22 includes a casing 26 shaped into the form of a handgun. Casing 26 includes a handle 28 and a biased telescoping trigger 30. Trigger 30 operates as the driver of the tag attacher which activates a pin (not shown) which in turn pushes the bar section of a fastener through bore 13 in needle 10 in a well known manner. Attacher 22 includes a front end or nose 20 to which needle 10 is coupled.

The nose 20 of attacher 22 includes an opening 32 in which end 11*a* of needle 10 is releasably attached. An arcuate notch 17 is formed in the first end 11*a* of needle 10 and cooperates with a shaft 36 activated by knob 34 on attacher 22 for clamping the needle in position. Shaft 36 includes a notch 38 in alignment with notch 17 in first end 11*a* of needle 10.

When knob 34 is in the position depicted in FIG. 4, the shaft 36 will be in clamping engagement with needle 10 at notch 17. However, when knob 34 is rotated in the direction indicated by arrow A in FIG. 4, notch 38 in shaft 36 will be oriented to allow needle 10 to be easily removed from the device. In this fashion, needle 10 can be easily replaced.

When needle 10 is properly seated in opening 32 in front end 20 of tag attacher 22 and is secured therein by means of rod or shaft 36, collar or flange 16 abuts against front surface 20 of apparatus 22. Accordingly, any force exerted perpendicular to the longitudinal extent of needle 10 or any lateral stresses will be uniformly transmitted to front surface 20 of apparatus 22 thereby preventing or minimizing breaking of needle 10 and potential damage to front surface 20 of apparatus 22. Where conventional needles cause front surface 20 of attacher 22 to break, the entire unit must be replaced.

Reference is now made to FIGS. 5 through 7 which depict a needle, generally indicated at 60, and constructed in accordance with a second embodiment of the invention. Needle 60 is constructed similar to needle 10 depicted in FIGS. 1 through 4 for use in tag attachers but includes an alternative collar construction, as described below. Like reference numerals in FIGS. 1 through 4 have been used in FIGS. 5 through 7 to indicate like parts. Needle 60 includes an elongated body 11 having a first mounting end 11*a* and a second piercing end 11*b*. First end 11*a* of needle 60 is adapted to be attached in the front end 20 (FIG. 6) of tag attacher 22 which acts as a complementary mounting for needle 60 in the same manner as discussed above with reference to FIGS. 1 through 4. First end 11*b* of needle 60 includes a sharp beveled point 12.

Needle 60 includes a longitudinally extending bore 13 and a corresponding longitudinally extending slot 14. Bore 13 allows the bar section of a fastener to pass through the needle. Slot 14 allows the filament of the fastener to slide along the length of needle 60.

Proximate first end 11*a* of needle 60 is a collar 62 in the form of a disk 64 which is secured to needle 60 to be disposed essentially perpendicular thereto. As depicted in FIG. 6, when needle 60 is mounted in nose 20 of tag attacher 22, disk 64 abuts against nose 20 in the same manner that collar or flange 16 on needle 10 abuts against nose 20 of the tag attacher as depicted in FIG. 4. Disk 64 is preferably of metallic construction.

It is noted that end 11*a* of needle 60 is enlarged from the remainder of needle 60 so that end 11*a* is properly sized for being received and secured in opening 32 in nose 20. Needle 60 includes a arcuate notch 17 in end 11*a* thereof which cooperates with shaft 36 activated by knob 34 for clamping the needle in position as described above.

As depicted, disk 64 is in the form of a C-ring which is secured to needle 60 by snap engagement in a needle groove 74. More particularly, the disk or C-ring 64 includes fingers 66, 68 and 70 which seat in groove 74 when the C-ring is snap engaged in the position shown. Thus, groove 74 in cooperation with fingers 66, 68 and 70 prevent C-ring 64 from being displaced from its mounted position on needle 60. It is noted that the ends of fingers 66, 68 and 70 are slightly concave so as to properly interfit on the needle 60.

C-ring 64 is open along an arc thereof to define confronting end faces 80 and 82. C-ring 64 is mounted on needle 60 such that the opening defined by end faces 80 and 82 is in alignment with slot 14 so as to permit the filament of a fastener to slide along needle 60 unobstructed.

Since collar 62 in the form of C-ring 64 abuts against front surface 20 of tag attacher 22 when needle 60 is mounted thereon, any force exerted perpendicular to the longitudinal extent of needle 60 or any lateral stresses will be uniformly transmitted to front surface 20 thereby preventing or minimizing breaking of needle 60 and damage to tag attacher 22.

Accordingly, the improved needle construction of the present invention provides a collar which abuts against the front surface of the tag attacher which substantially prevents the needle and the gun from breaking or damage at this region under normal usage conditions. By providing such an improved needle construction, the present invention increases the efficiency of conventional tag attachers by minimizing if not avoiding the replacement of broken needles and the potential replacement of the entire tag attaching apparatus should it break due to excessive lateral stress placed on the needle during tagging operations.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A needle for use in tag attachers comprising an elongated body having first and second ends, the first end of said body being attachable in an opening in a tag attacher and the second end of said body having a point, said elongated body having a longitudinally extending bore and a longitudinally extending slot in alignment with said bore, said elongated body having a collar larger than said opening in said tag attacher proximate the first end of said body, said collar abutting against an outer surface of said tag attacher when said needle is secured in said opening of said tag attacher.

2. The needle as claimed in claim 1, wherein said collar is fixed towards the first end of said body.

3. The needle as claimed in claim 1, wherein said first end of said body includes mounting means for releasably attaching said needle in said opening of said tag attacher.

4. The needle as claimed in claim 3, wherein said mounting means includes a notch cut in the first end of said body, said tag attacher including locking means for holding said needle in said opening of said tag attacher by means of said notch.

5. The needle as claimed in claim 3, wherein said collar is integrally formed with said body.

6. The needle as claimed in claim 1 or 3, wherein said collar is a disk secured to said elongated body.

7. The needle as claimed in claim 6, wherein said disk is essentially perpendicular to said elongated body.

8. The needle as claimed in claim 7, wherein said elongated body includes an annular groove proximate the first end thereof, said disk being secured to said body in said groove.

9. The needle as claimed in claim 8, wherein said disk is a C-ring.

10. The needle as claimed in claim 9, wherein said C-ring includes an opening in alignment with said slot.

11. The needle as claimed in claim 10, wherein said C-ring includes radially extending fingers which hold said C-ring to said body in said groove.

12. The needle as claimed in claim 7, wherein said disk is an C-ring.

13. The needle as claimed in claim 12, wherein said C-ring is formed from metal.

14. A tag attaching apparatus using one piece plastic fasteners, each fastener including a bar section and a head section joined by a filament, comprising a frame having an opening in a front end thereof, a needle releasably mounted in said opening of said front end of said frame, said needle having a collar which is larger than said opening which abuts against the front end of said frame, said needle having a longitudinally extending bore which allows the bar section of said fastener to pass through said needle and a corresponding longitudinally extending first slot which permits the filament section of said fastener to travel along said needle, and driving means mounted on said frame for pushing the bar section of said fastener through said bore.

15. The tag attaching apparatus as claimed in claim 14, wherein said collar is flared towards the front end of said frame.

16. The tag attacher as claimed in claim 15, wherein said needle includes a notch therein, said frame including a locking means for releasably capturing said notch.

17. The tag attacher as claimed in claim 14, wherein said collar is formed integrally with said needle.

18. The tag attacher as claimed in claim 14, wherein said needle includes a second slot which allows the bar section of said fastener to enter said bore.

19. The tag attacher as claimed in claim 14, wherein said collar is a disk secured to said needle.

20. The tag attacher as claimed in claim 19, wherein said disk is a C-ring.

21. A needle for use in a tag attacher comprising an elongated body having first and second ends, said first end being adapted for removable attachment to a complementary opening in the tag attacher and said second end having a point for piercing an article, said elongated body having a longitudinally extending bore and longitudinally extending slot communicating therewith, said elongated body having an annular groove therein proximate the first end of said body and an annular collar means seated in said groove, said collar means being larger then said opening and being adapted to interfit with and abut against an outer surface of the tag attacher when the needle is secured in said opening.

22. The needle as claimed in claim 21, wherein said collar means is a C-ring.

* * * * *